US008602158B2

(12) United States Patent
Hayama et al.

(10) Patent No.: US 8,602,158 B2
(45) Date of Patent: Dec. 10, 2013

(54) MUFFLER SYSTEM WITH PROTECTOR FOR SMALL-SIZED VEHICLE

(75) Inventors: Yoshitaka Hayama, Wako (JP); Takahiro Yanagisawa, Wako (JP); Yasuhiro Yokoyama, Wako (JP); Hiromi Shibata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/593,753

(22) Filed: Aug. 24, 2012

(65) Prior Publication Data

US 2013/0068554 A1 Mar. 21, 2013

(30) Foreign Application Priority Data

Sep. 21, 2011 (JP) ..... 2011-206075

(51) Int. Cl.
*F01N 13/08* (2010.01)

(52) U.S. Cl.
USPC ..... 181/228; 181/227; 181/212

(58) Field of Classification Search
USPC ..... 181/228, 212, 227
See application file for complete search history.

(56) References Cited

U.S. PATENT DOCUMENTS

| | | | | |
|---|---|---|---|---|
| 5,036,947 | A * | 8/1991 | Metzger | 181/241 |
| 5,474,123 | A * | 12/1995 | Buckshaw | 165/134.1 |
| 6,438,949 | B1 * | 8/2002 | Nozaki | 60/322 |
| 6,789,644 | B2 * | 9/2004 | Mukaida | 181/272 |
| 7,240,767 | B2 * | 7/2007 | Nakagawa | 181/227 |
| 7,946,380 | B2 * | 5/2011 | Yamamoto et al. | 181/227 |
| 8,028,798 | B2 * | 10/2011 | Koyanagi et al. | 181/251 |
| 2002/0166719 | A1 * | 11/2002 | Dooley | 181/228 |
| 2004/0216453 | A1 * | 11/2004 | Oshima et al. | 60/322 |
| 2006/0042871 | A1 * | 3/2006 | Yasuda et al. | 181/227 |

FOREIGN PATENT DOCUMENTS

JP 4400823 B2 1/2010

* cited by examiner

*Primary Examiner* — Forrest M Phillips
(74) *Attorney, Agent, or Firm* — Squire Sanders (US) LLP

(57) ABSTRACT

A muffler system can include an exhaust pipe configured to be connected to an exhaust port of an engine, and a muffler containing a catalyst. The muffler is configured to be connected to a downstream side of the exhaust pipe, and can include a first protector stay covering an upper surface of a high-temperature portion of the muffler. The first protector stay creates a front opening and a rear opening between an upper surface of the muffler and front and rear portions of the protector stay. A muffler protector is attached to the protector stay, the muffler protector being configured to cover an upper surface of the muffler.

10 Claims, 8 Drawing Sheets

MUFFLER SYSTEM WITH PROTECTOR FOR SMALL-SIZED VEHICLE

BACKGROUND

1. Field

The present invention relates to a muffler system with a protector which is connected to an exhaust system of an engine of a small-sized vehicle such as a motorcycle. Particularly, the present invention relates to a muffler system with a protector for a small-sized vehicle, in which a rise in the temperature of a muffler protector covering a muffler containing a catalyst is curbed, and a bulge of the muffler protector to the periphery of the muffler is curbed to enhance external appearance.

2. Description of Related Art

A muffler system with a protector for a motorcycle in which a muffler protector covering a muffler containing a catalyst is formed in a dual structure and the temperature of the surface of the muffler protector is thus lowered, for example, in Patent Document 1 (Japanese Patent No. 4400823).

The muffler with the protector disclosed in Patent Document 1, however, not only poses a problem that because the muffler protector bulges out around the muffler to a large extent, the muffler protector bulges out excessively and spoils the appearance in a case where, for example, the muffler protector is applied to a muffler placed near a seat for a rider. This configuration also poses a problem that because hot air from the muffler directly reaches the muffler protector, the effect of curbing a rise in the temperature of the muffler protector needs to be enhanced further.

SUMMARY

The present invention has been made with the foregoing situation taken into consideration. An object of the present invention is to provide a novel muffler system with a protector for a small-sized vehicle, which is capable of solving the foregoing problems. In certain embodiments of the invention, by use of plate-shaped protector stays for supporting a muffler protector while covering an upper surface of a high-temperature portion of a muffler, hot air between the muffler and the muffler protector, which are arranged in such a manner as to be inclined upward from front to back, is actively discharged to the rear of a vehicle through heat convection. A rise in the temperature of the muffler protector is curbed and the muffler protector's intrinsic function of heat insulation is enhanced accordingly. By placing the muffler protector adjacent to the protector stays, the outward bulge of the muffler protector is curbed and external appearance is thus suitably arranged.

In certain embodiments, therefore, the invention includes a muffler system with a protector for a small-sized vehicle in which a seat for a rider is placed above a rear wheel suspended on a rear portion of a vehicle body frame. A muffler containing a catalyst is connected to a downstream portion of an exhaust pipe which communicates with an exhaust port of an engine mounted on the vehicle body frame. Near the seat, the muffler is placed inclining its longitudinal direction upward from front to back in line with a front-rear direction of the vehicle body frame. The muffler is provided with a plate-shaped protector stay covering an upper surface of a high-temperature portion of the muffler. A front opening and a rear opening are formed between an upper surface of the muffler and front and rear portions of the protector stay. The protector stay is provided with a muffler protector covering the upper surface of the muffler.

In some embodiments, the muffler protector extends covering the protector stay and the muffler, and wind guiding ports for guiding a running wind are opened in an intermediate area of a front portion of the muffler protector.

In some embodiments, the protector stay and a different protector stay are attached to the muffler with a gap between the protector stay and the different protector stay in the front-rear direction. The wind guiding ports of the muffler protector are situated in a space between the protector stay and the different protector stay.

In certain embodiments, the muffler protector is formed in a dual structure including an outer muffler protector and an inner muffler protector, and a rear portion of the outer muffler protector is formed of a material which is higher in heat resistance than a material of a front portion of the outer muffler protector.

In certain embodiments, wind guiding ports are respectively formed in the outer and inner muffler protectors while shifting the wind guiding ports from each other in the front-rear direction.

In certain embodiments, the dual-structure muffler protector is attached to the muffler after the outwardly-situated outer muffler protector and the inwardly-situated inner muffler protector are pre-assembled into the muffler protector.

In certain embodiments, the muffler can include a plurality of expansion chambers defined by partitioning the inside of the muffler in the front-rear direction with separators, and the protector stay covers the upper surface of a rear area including the expansion chamber which is the rearmost among the expansion chambers.

According to some embodiments of the invention, not only while the vehicle is running by the operation of the engine but also after the engine stops its operation, the heat from the muffler, which is heated to high temperature due to the heat of reaction from the catalyst and the exhaust heat of the exhaust gas, passes between the muffler and the protector stay via the openings between the muffler and the front and rear portions of the protector stay, and is discharged to the rear. Thereby, a rise in the temperature of the muffler protector can be reduced. Accordingly, it is possible to prevent a problem that the hot air from the muffler spreads from near the seat for a rider to the outside. In addition, the outward bulge of the muffler protector from the muffler can be curbed by placing the muffler protector adjacent to the protector stay and constructing the muffler protector in a smaller size, and the external appearance of the muffler protector can be enhanced.

According to some embodiments, therefore, the muffler protector extends covering the protector stay and the muffler, and the wind guiding ports for guiding the running wind are opened in the intermediate area of the front portion of the muffler protector. Thereby, while the vehicle is running, the running wind which flows along the lateral side of the vehicle body can be efficiently taken into the interstice between the muffler protector and the muffler. Accordingly, heated parts such as the inside of the protector stay and the interstice between the protector stay and the muffler protector can be efficiently cooled. In addition, the muffler protector can be constructed in a smaller size, and the external appearance can be enhanced.

Additionally, in some embodiments, the protector stay and the different protector stay are attached to the muffler with a gap therebetween in the front-rear direction. The wind guiding ports formed in the muffler protector are situated in the space between the protector stay and the different protector stay. For these reason, the protector stays enable the large-sized muffler protector widely covering the muffler to be stably supported by the muffler. In addition, the running wind from the wind guiding ports can be efficiently guided to the interstice between the muffler and the muffler protector without being disturbed by the protector stays. The protector stays and the muffler protector can be efficiently cooled. The muffler protector no longer bulges outward. Accordingly, the muffler protector can be constructed in a smaller size and the external appearance can be enhanced.

According to some embodiments, the rear portion of the outer muffler protector is formed of the material which is higher in heat resistance than the material of the front portion thereof. For this reason, the use of the expensive material with the higher heat resistance can be limited to the necessary area and the inexpensive material which is low in heat resistance but good in external appearance can be used in the wider area. Thereby, it is possible to reduce the costs and to enhance the external appearance while securing the heat resistance.

According to some embodiments, the wind guiding ports are respectively formed in the outer and inner muffler protectors in the dual structure in a way that shifts the wind guiding ports from each other in the front-rear direction. For this reason, the running wind can be efficiently guided to the outer surface of the muffler via the wind guiding ports although the muffler protector is formed into the dual structure. In addition, the wind guiding port of the inner muffler protector is not exposed to the outside, and it is thus possible to enhance the external appearance of the dual-structure muffler protector.

In some embodiments, the muffler protector is attached to the muffler after the outwardly-situated outer muffler protector and the inwardly-situated inner muffler protector are preassembled into the muffler protector. For this reason, it is possible to enhance ease of assembly and maintenance of the muffler protector despite its dual structure.

According to some embodiments, the high-temperature area including the rearmost expansion chamber, which becomes highest in temperature due to the movement of the hot air (as a result of the muffler being inclined upward from front to back) after the engine is stopped, is covered with the protector stay. For this reason, it is possible to enhance the effect of heat insulation by the protector stay, to effectively curb a rise in the temperature of the muffler protector, to construct the muffler system with a protector in a much smaller size, and to enhance the external appearance.

DETAILED DESCRIPTION

Embodiments of the present invention will specifically be described below on the basis of the accompanying drawings.

Front, rear, left, right, upper, and lower remarks in the descriptions of the following embodiment are based on a traveling direction of a motorcycle on which an exhaust system Ex is mounted.

An embodiment represents a case where a muffler system with a protector of the present invention is carried out as the exhaust system Ex which is mounted on the motorcycle.

Figure 1:
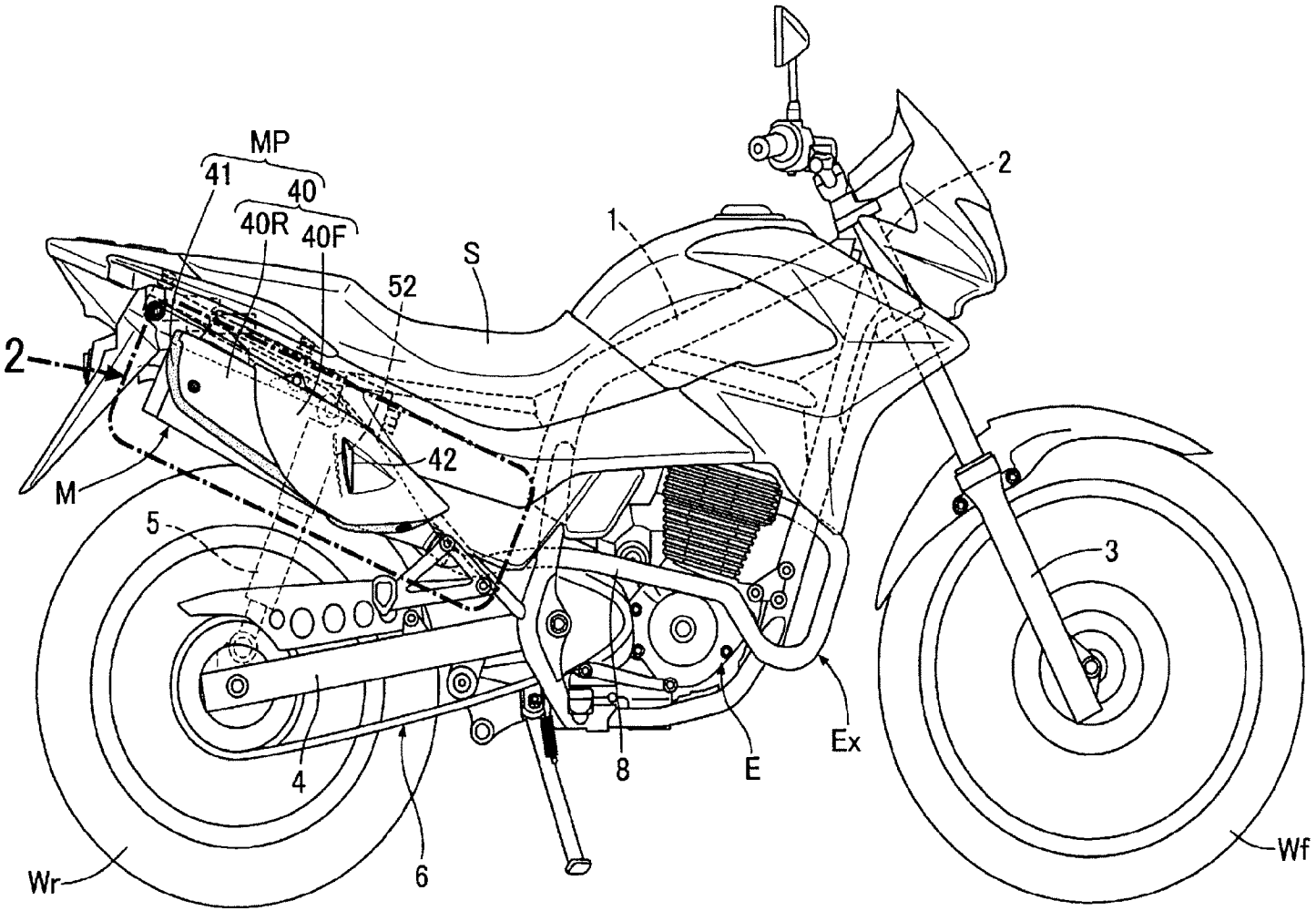
FIG. 1 is a side view of a motorcycle including a muffler system with a protector according to an embodiment of the present invention.
Figure 2:
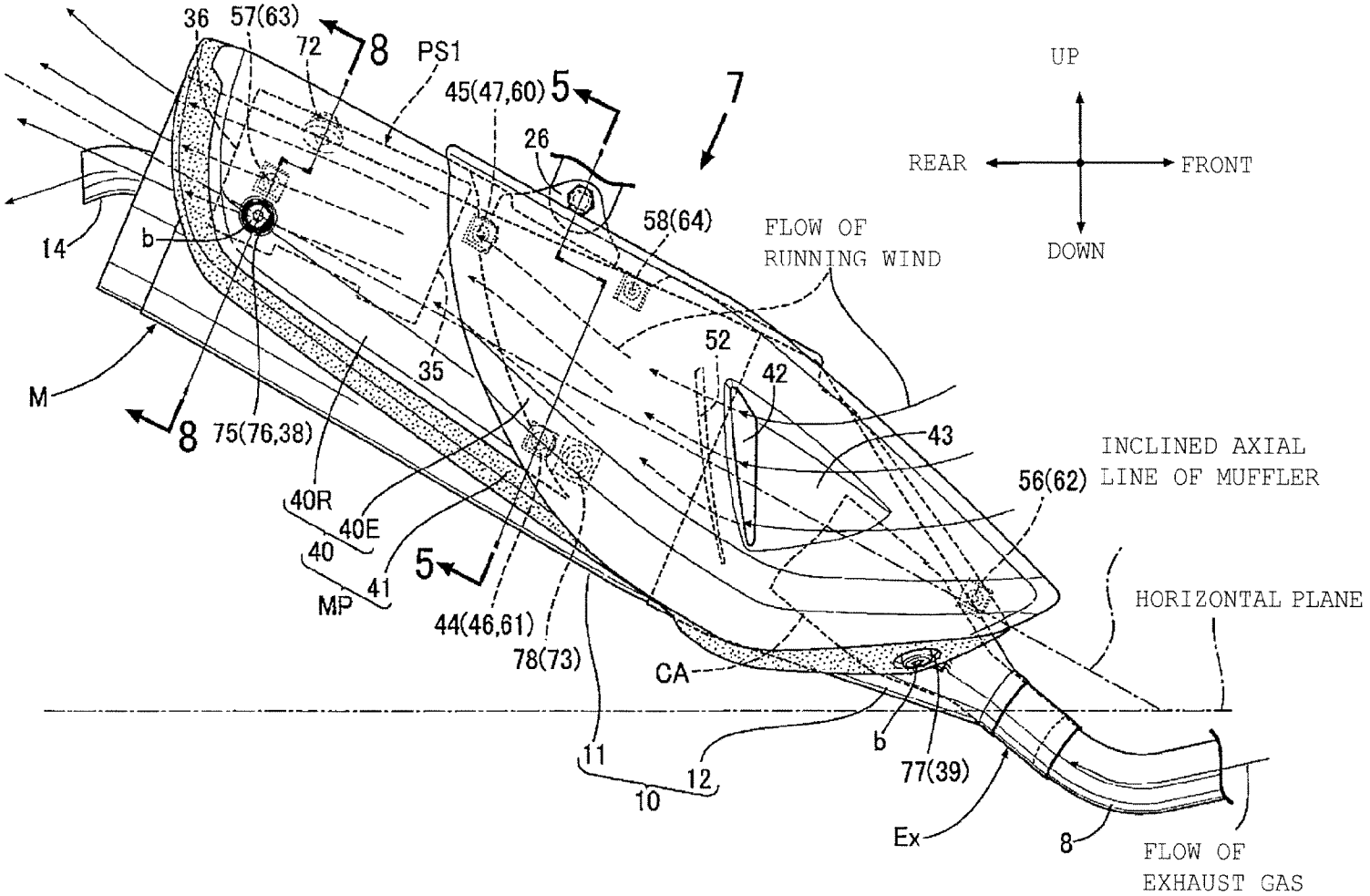
FIG. 2 is a magnified view of a portion surrounded by an imaginary line which is viewed in the direction of Arrow 2 in FIG. 1.

FIG. 1 shows a saddle riding-type motorcycle including the muffler system with a protector according to an embodiment of the present invention. A head pipe 2 is provided at a front-end portion of a vehicle body frame 1 formed of pipe members and the like. A front wheel Wf is suspended on front forks 3 which are steerably supported by this head pipe 2. A swingarm 4, on which a rear wheel Wr is suspended, is mounted on a pivot in the rear portion of the vehicle body frame 1 in a vertically swingable manner. This swingarm 4 is supported by the vehicle body frame 1 with the assistance of rear cushion units 5. A driving engine E is mounted in a center lower portion of the vehicle body frame 1. An output shaft of this engine E is connected to the rear wheel Wr via a power transmission mechanism 6. In addition, a saddle riding-type seat S for a rider is provided on an upper part of the vehicle body frame 1 above the rear wheel Wr.

The exhaust system Ex configured to discharge an exhaust gas, which is discharged by the operation of this engine E, to the outside is connected to an exhaust port of the driving engine E. This exhaust system Ex includes an exhaust pipe 8 which extends under the seat S toward the rear of the vehicle body frame 1. The muffler system with a protector of the present invention, which is obliquely extended to the rear upward from front to back under the seat S, is connected to a downstream end of this exhaust pipe 8.

This muffler system with a protector includes a muffler M containing a catalyst CA, a dual-structure muffler protector MP covering this muffler M, and a protector stay PS1 and a different protector stay PS2 for attaching this muffler protector MP to the muffler M.

Thus, the exhaust gas which is discharged from the engine E by the operation thereof enters the muffler M via the exhaust pipe 8. While the exhaust gas passes through the catalyst CA in the muffler M, harmful substances such as HC, CO and NOx are removed. Thereafter, the resultant exhaust gas enters an expansion chamber (silencing chamber), and is thereby made silent and eventually discharged to the atmosphere. In addition, the muffler, which is heated to a high temperature due to the exhaust heat of the exhaust gas and the heat of reaction of the catalyst CA, is covered with the muffler protector MP. Thereby, the heat of the muffler is avoided from being discharged to the outside.

Figure 3:
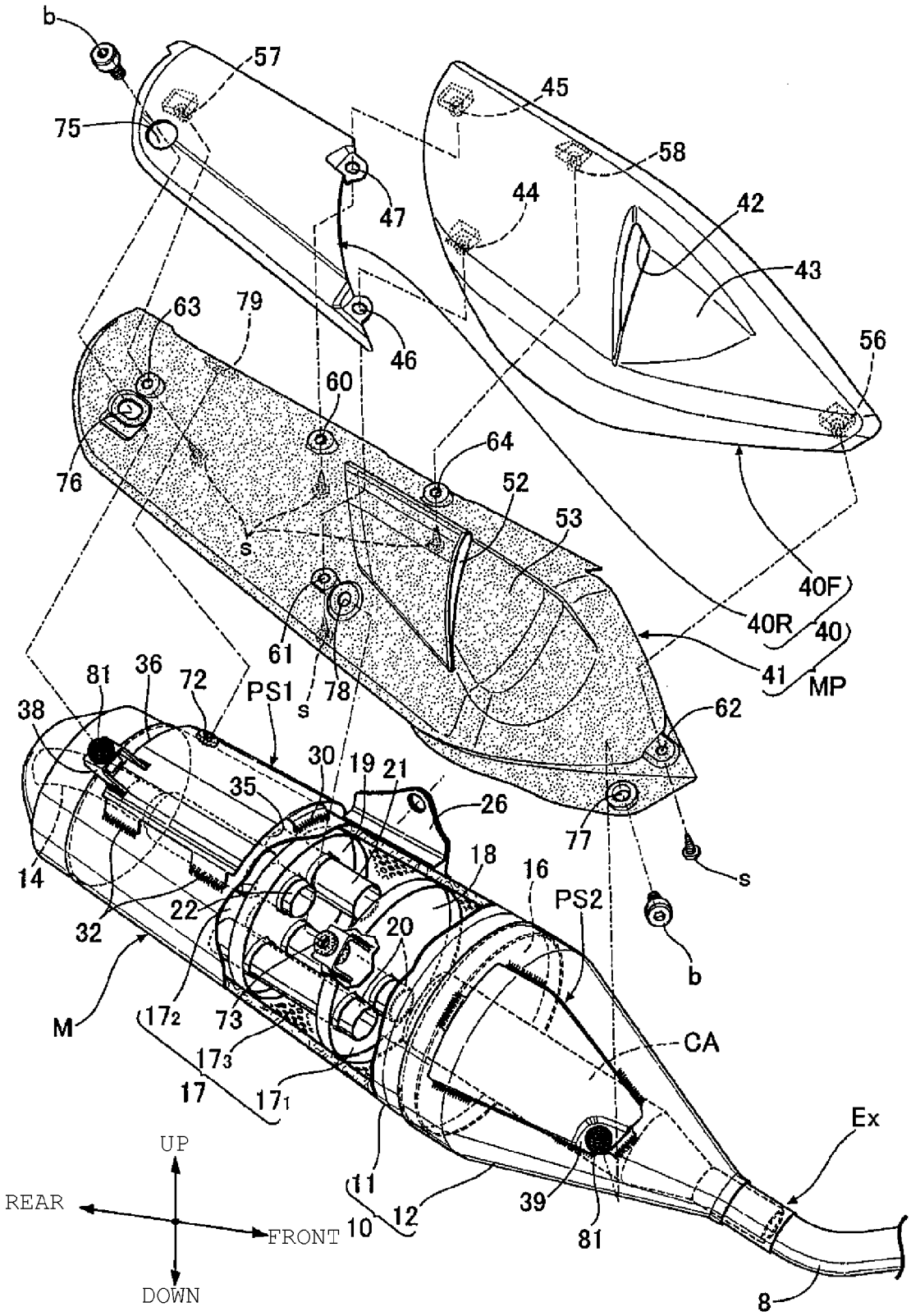
FIG. 3 is an exploded perspective view of the muffler system with a protector according to an embodiment of the present invention.
Figure 6:
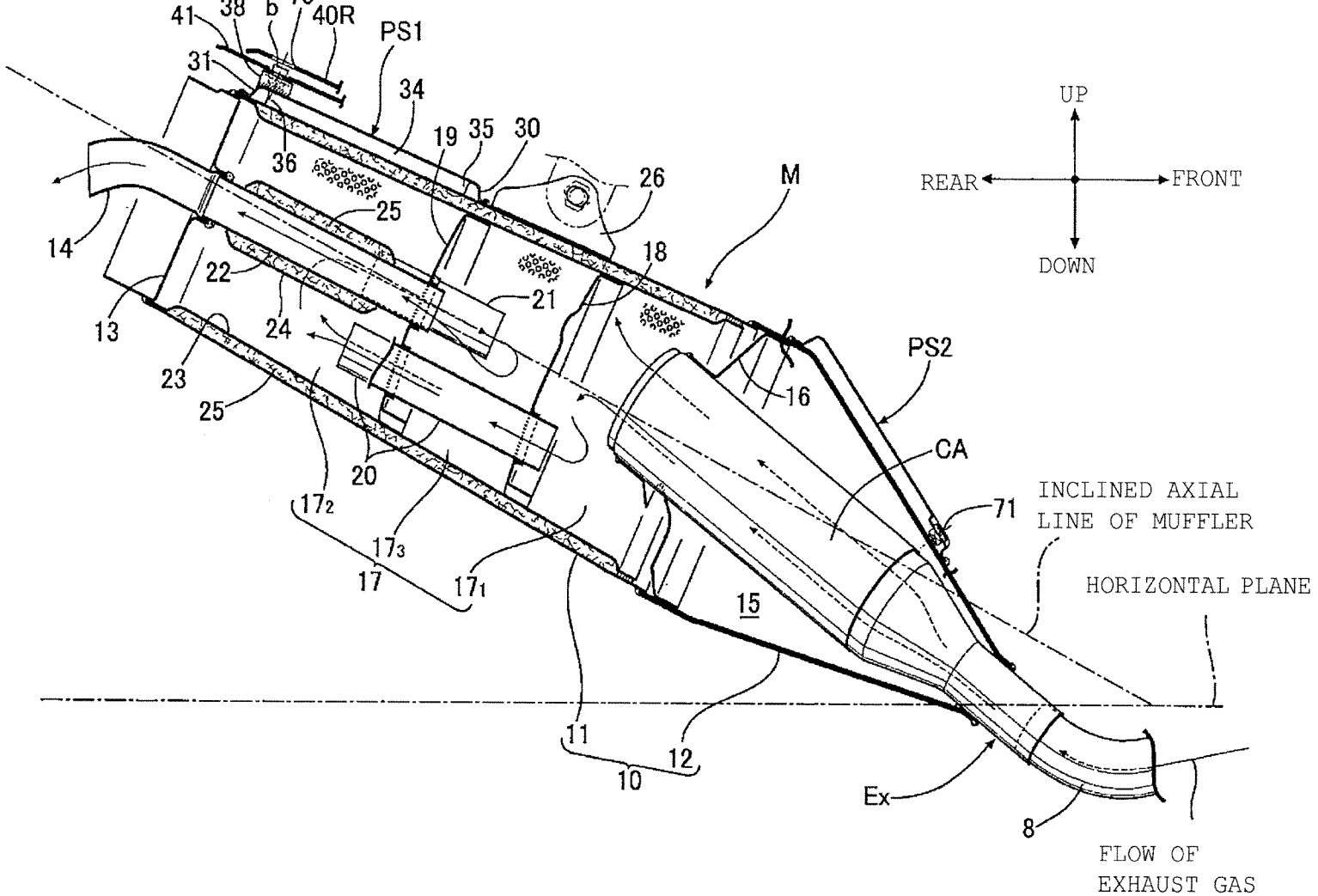
FIG. 6 is a cross-sectional view taken along the line 6-6 of FIG. 5.
Figure 7:
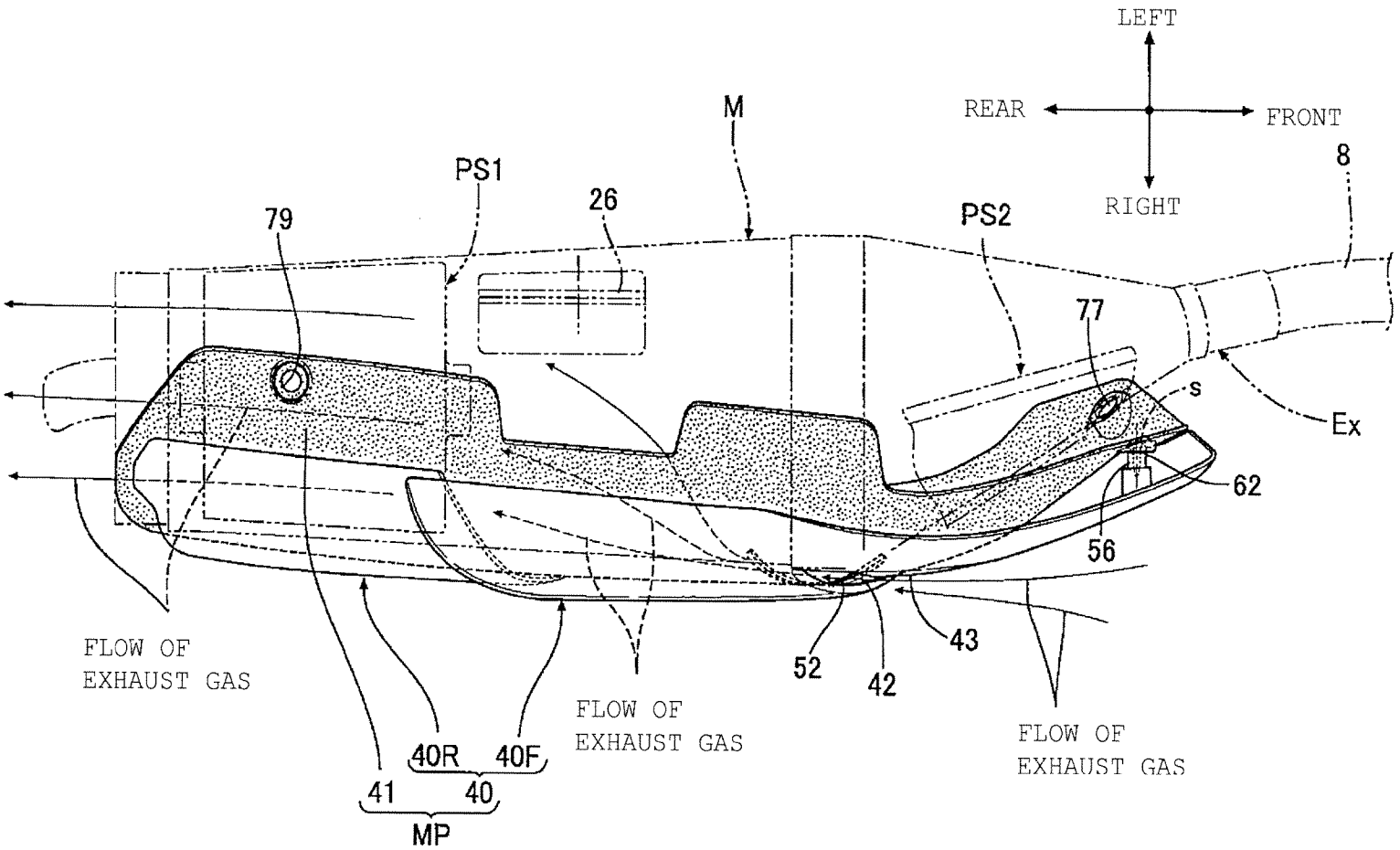
FIG. 7 is a diagram viewed in the direction of the arrow line 7 of FIG. 2.

Descriptions will be provided for the structure of the muffler M containing the catalyst CA by referring mainly to FIGS. 3 and 6.

This muffler M inclines upward in the longitudinal direction, that is to say, from the upstream to downstream sides in a direction in which the exhaust gas flows (i.e., inclines upward from front to back). The muffler M is supported by the vehicle body frame 1 with the assistance of a muffler stay 26.

A muffler main body 10, which constitutes an outer shell of the muffler M, is hermetically formed by using a cylindrical trunk section 11 whose diameter becomes gradually smaller from the upstream to downstream sides. A front section 12 is connected to a front end of the trunk section 11 and shaped into a truncated cone which is tapered toward its front end (upstream end). An end plate occludes a rear end (downstream end) of the trunk section 11. A rear end (downstream end) of the exhaust pipe 8 is connected to the front end (upstream end) of the front section 12. A tail pipe 14, which is open to the outside, is connected to the end plate 13.

A catalyst chamber 15 is formed inside the front section 12 of the muffler main body 10. The catalyst CA can be contained in therein. This catalyst CA is shaped like a cylinder. A front end (upstream end) of the catalyst CA penetrates and gets supported by the front end of the muffler main body 10, thereby being connected to the exhaust pipe 8. In addition, a rear end of the catalyst CA penetrates and gets supported by a support plate 16 which is provided at the front section 12 in the muffler main body 10. Furthermore, a rear end (downstream end) of the catalyst CA is open to the inside of an expansion chamber 17 which is formed inside the muffler main body 10. Thereby, the exhaust gas cleaned by the catalyst CA is allowed to flow into the expansion chamber 17. First and second separators 18, 19 for partitioning the inside of the muffler main body 10 into first, second and third expansion chambers $\mathbf{17}_1$, $\mathbf{17}_2$, $\mathbf{17}_3$ are provided in the middle portion of the inside of the trunk section 11 of the muffler main body 10 in the longitudinal direction. Communicating pipes 20 are supported by the first and second separators 18, 19. These communicating pipes 20 make the first and second expansion chambers $\mathbf{17}_1$, $\mathbf{17}_2$ communicate with each other, and a different communicating pipe 21 is supported by the second separator 19. This different communicating pipe 21 makes the second and third expansion chambers $\mathbf{17}_2$, $\mathbf{17}_3$ communicate with each other. Overall, the first, second and third expansion chambers $\mathbf{17}_1$, $\mathbf{17}_2$, $\mathbf{17}_3$ inside the muffler main body 10 function as the virtually unitary expansion chamber 17. Moreover, an outlet pipe 22 penetrates and gets supported by the second separator 19 and the end plate 13. This outlet pipe 22 makes the third expansion chamber $\mathbf{17}_3$ and the tail pipe 14 communicate with each other and discharges the exhaust gas silenced in the expansion chamber 17 to the outside.

A noise-absorbing material holding plate 23, in which punch holes are punched, is provided on an inner peripheral surface of the trunk section 11 of the muffler main body 10. A noise-absorbing material 25 such as glass wool is filled between the inner peripheral surface and the noise-absorbing material holding plate 23. In addition, another noise-absorbing material holding plate 24, in which punch holes are punched, is provided on an outer peripheral surface of the outlet pipe 22. Another noise-absorbing material 25 such as glass wool is filled between the outer peripheral surface and the noise-absorbing material holding plate 24.

The muffler stay 26 is fixed to the upper portion of the trunk section 11. The muffler M is supported by the vehicle main body 1 with the assistance of this muffler stay 26.

The protector stay PS1 is integrally attached to an upper surface of a rear portion of the trunk section 11 of the muffler main body 10, which corresponds to the second expansion chamber $\mathbf{17}_2$ (that becomes highest in temperature after the engine E is stopped). The different protector stay PS2 is integrally attached to an upper surface of the front section 12 (which becomes high in temperature due to the heat of reaction of the catalyst CA) of the muffler main body 10.

Figure 4:
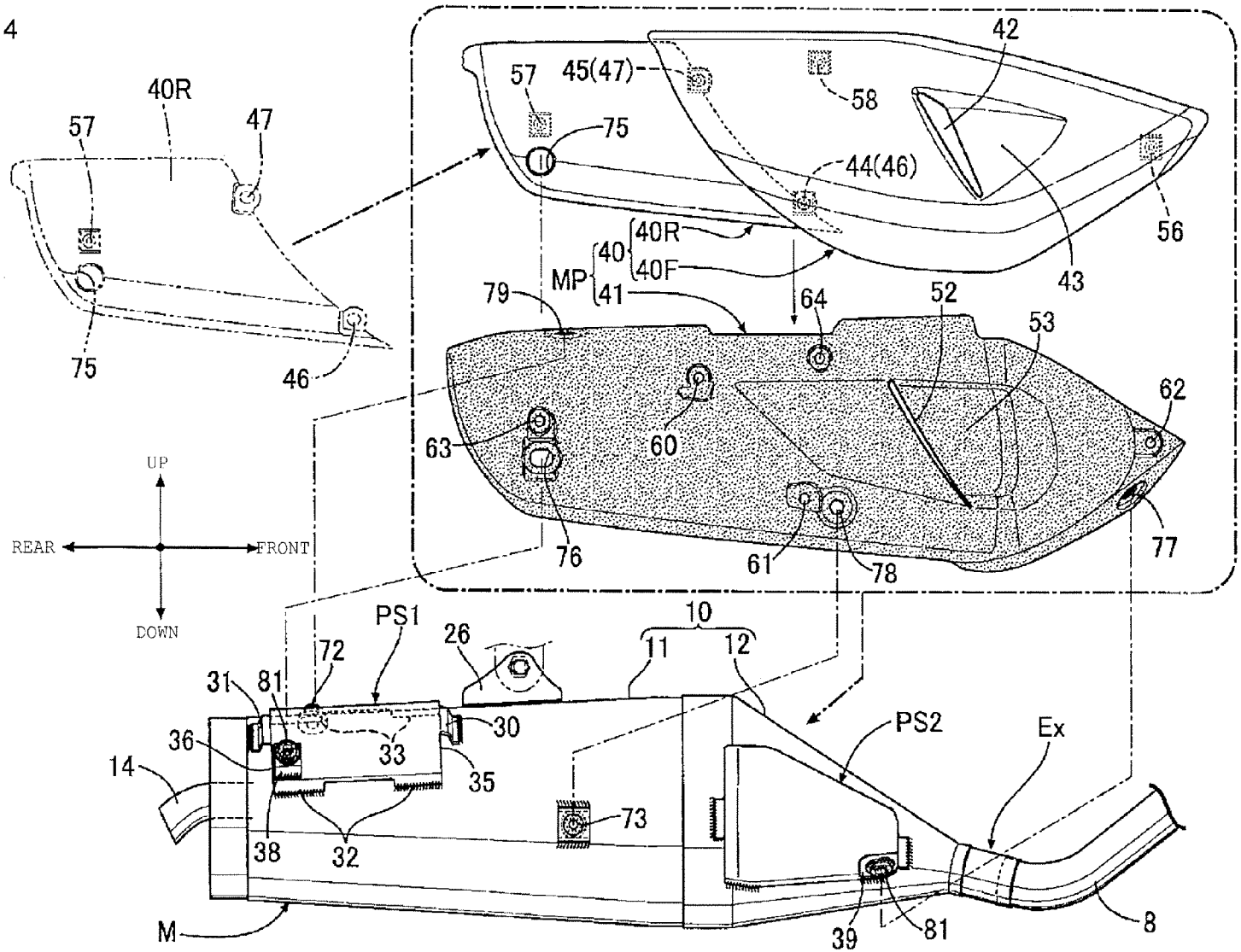
FIG. 4 is an exploded plan view of the muffler system with a protector according to an embodiment of the present invention.

As shown in FIGS. 3 and 4, the transverse cross-sectional shape of the protector stay PS1 in a direction intersecting the longitudinal direction of the muffler M (i.e., the direction in which the exhaust gas flows) is shaped like an arc extending along the contour of the upper surface of the trunk section 11 of the muffler main body 10, and the plan shape thereof is shaped like a square plate. This protector stay PS1 is fixed to the upper surface of the trunk section 11 of the muffler main body 10, which corresponds to the second expansion chamber $\mathbf{17}_2$ (see FIG. 8). Front and rear attachment tongues 30, 31 extending downward, are integrally projectingly provided on the center portions of the front and rear end edges of the protector stay in the widthwise direction, respectively. Left and right attachment tongues 32, extending downward, are integrally projectingly provided on the left and right side edges of the protector stay, respectively. Lower ends of the respective attachment tongues 30 to 33 are welded to the upper surface of the trunk section 11 of the muffler main body 10.

Figure 5:
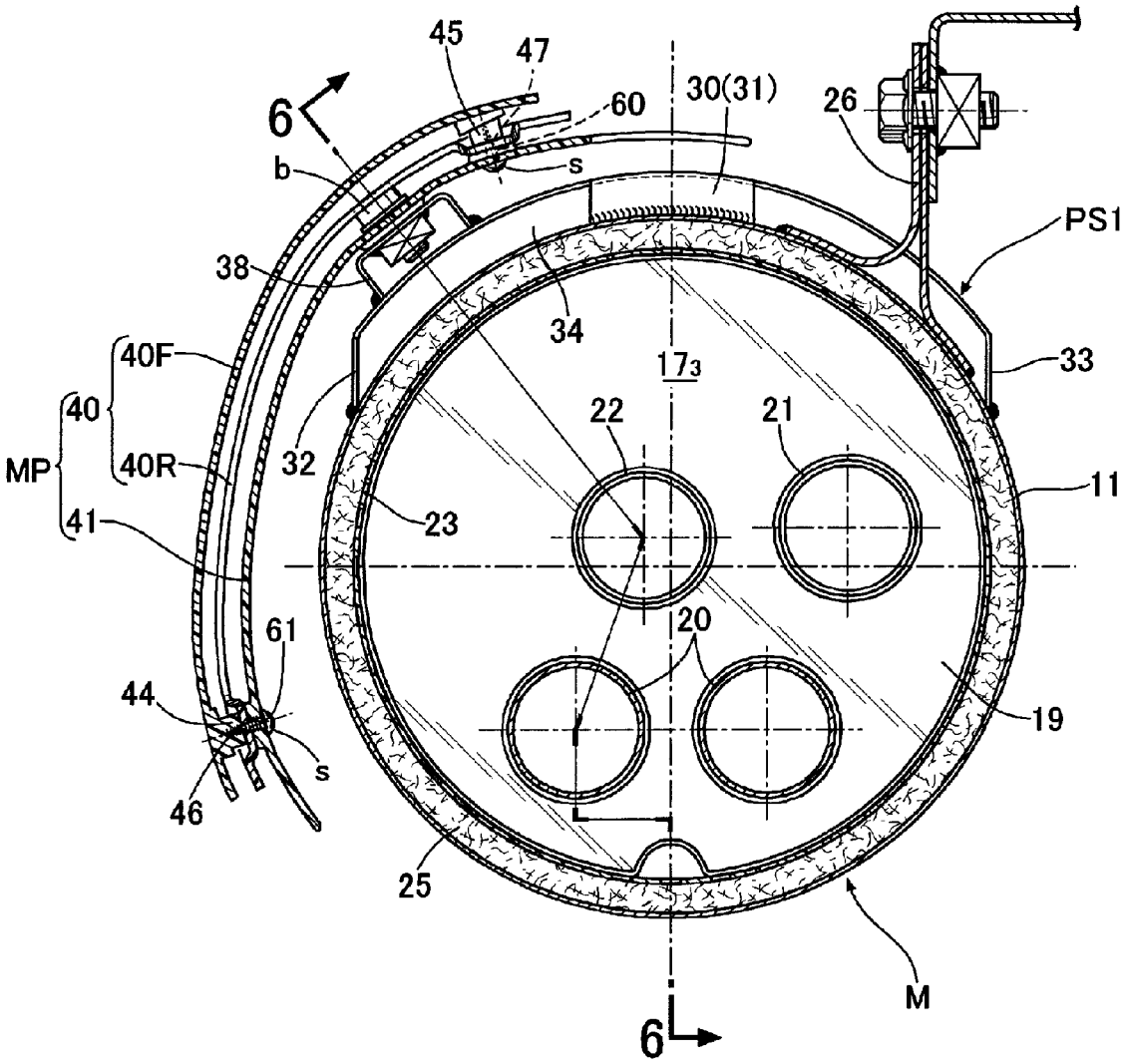
FIG. 5 is a magnified cross-sectional view taken along the line 5-5 of FIG. 2.
Figure 8:
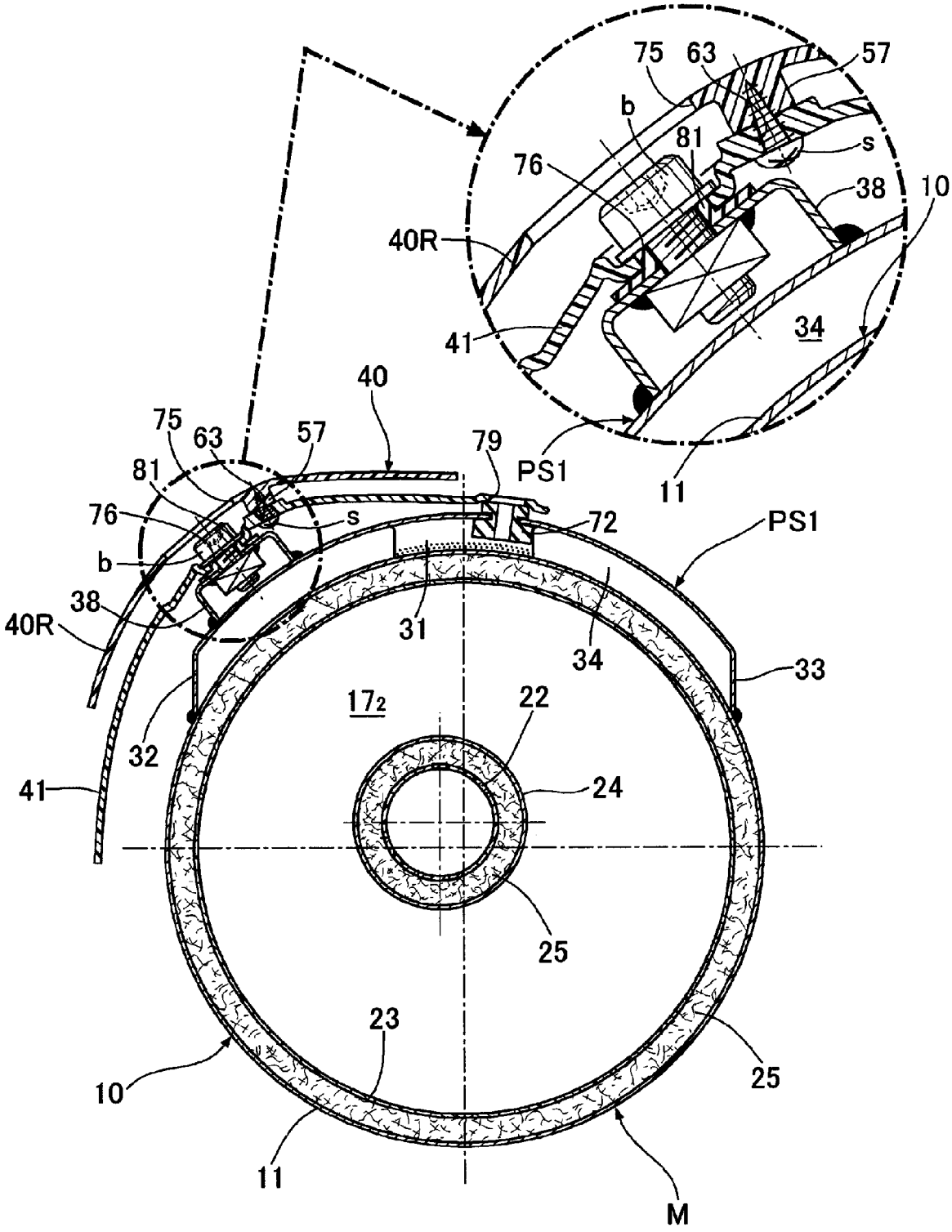
FIG. 8 is a magnified cross-sectional view taken along the line 8-8 of FIG. 2.

As shown in FIGS. 5, 6 and 8, a heat-insulating space 34 is actively formed between the protector stay PS1 and the upper surface of the trunk section 11 of the muffler main body 10. A front opening 35 communicating with the heat-insulating space 34 is formed between a front portion of the protector stay PS1 and the upper surface of the trunk section 11 of the muffler main body 10, while a rear opening 36 communicating with the heat-insulating space 34 is formed between a rear portion of the protector stay PS1 and the upper surface of the trunk section 11 of the muffler main body 10, respectively. In this way, the plate-shaped protector stay PS1 functions as a heat-insulating member for curbing the transmission of the exhaust heat from the muffler M to the muffler protector MP, which will be described later.

The different protector stay PS2 is fixed to an upper surface of the front section 12 (in which the catalyst CA is contained) of the muffler main body 10, which is shaped like a truncated cone, while providing a gap with the protector stay PS1 in the longitudinal direction of the muffler M (the direction in which the exhaust gas flows). The transverse cross-sectional shape of this different protector stay PS2 in the direction intersecting the longitudinal direction of the muffler is shaped like an arc extending along the contour of the upper surface of the front section 12 of the muffler main body 10, and the plan shape thereof is shaped like a triangular plate. The different protector stay PS2 is fixed to the upper surface of the front section 12 of the muffler M while being slightly offset from the protector stay PS1 in the left-right direction [i.e., a direction orthogonal to the longitudinal direction of the muffler M (i.e., the direction in which the exhaust gas flows)]. Front, rear, and side portions of the different protector stay PS2 are welded to the upper surface of the front section 12 of the muffle main body 10.

A gap is formed between the different protector stay PS2 and the upper surface of the front section 12 of the muffler main body 10. The running wind is allowed to flow through the gap.

As shown in FIGS. 3 and 4, attachment stays 38, 39 each having a shock-absorbing rubber 81 are provided on the upper surface of the rear end of the protector stay PS1 and the upper surface of the front end of the different protector stay PS2, respectively. The dual-structure muffler protector MP is adjacently and detachably attached to each of these attachment stays 38, 39.

Next, descriptions will be provided for the structure of the muffler protector MP.

The muffler protector MP includes an outer muffler protector 40 and an inner muffler protector 41.

The outer muffler protector 40 is formed by integrally joining a front outer muffler protector 40F and a rear outer muffler protector 40R. The front outer muffler protector 40F is integrally molded out of a synthetic resin (nylon 6), and the rear outer muffler protector 40R is integrally molded out of another synthetic resin (glass fiber-containing polypropylene glass) which is higher in heat resistance than the front outer muffler protector 40F. The front outer muffler protector 40F has a size which corresponds to the front section 12 and a front half of the trunk section 11 of the muffler main body 10, and is shaped like an arc extending along an outer peripheral surface of the muffler M. The front outer muffler protector 40F has a tapered shape toward the front end (upstream end) of the muffler main body 10, and the rear end thereof (i.e., the end which is connected to the rear outer muffler protector 40R) is formed into an arc surface in a projecting fashion in the left-right direction. On the other hand, the rear outer muffler protector 40R is formed smaller in size than the front outer muffler protector 40F, and has a size which corresponds to a rear half of the trunk section 11 of the muffler main body 10. The rear outer muffler protector 40R is shaped like an arc surface extending along the outer peripheral surface of the muffler M, and the front end thereof (i.e., the end which is connected to the front outer muffler protector 40F) is formed into an arch surface in a recessed fashion in the left-right direction. An outer wind or air guiding port 42 extending in the left-right direction for guiding the air, or running wind, is formed in an intermediate area of the front outer muffler protector 40F in the longitudinal direction (i.e., the direction in which the exhaust gas flows). In addition, a scoop-shaped outer wind guiding passage 43 extending to the outer wind guiding port 42 is formed therein.

The outer muffler protector 40 is formed of the front outer muffler protector 40F and the rear outer muffler protector 40R by fastening paired attachment bosses 44, 45, which are provided on a back surface of the rear portion of the front outer muffler protector 40F, to paired attachment holes 46, 47, which are provided on a front edge of the rear outer muffler protector 40R, by use of fastening screws s, respectively (see FIG. 5) (while the inner muffler protector 41 to be described later is fastened together). Decorative coatings, whose colors are different from each other, can be applied to the outer surface of the front outer muffler protector 40F and the outer surface of the rear outer muffler protector 40R, respectively, for the purpose of enhancing a design effect.

On the other hand, the inner muffler protector 41 is integrally molded out of, for example, a synthetic resin (nylon 6), and has a size which enables the inner muffler protector 41 to cover the front section 12 and the trunk section 11 of the muffler main body 10. The inner muffler protector 41 is shaped like an arc surface extending along the outer peripheral surface of the muffler main body 10. A front portion of the inner muffler protector 41 is formed into a tapered shape toward the front end along the front section 12 of the muffler M, which is shaped like the truncated cone. In the intermediate area of the inner muffler protector 41 in the longitudinal direction (i.e., the direction in which the exhaust gas flows), an inner wind guiding port 52 extending in the left-right direction for guiding the air or running wind is formed slightly in the rear of the outer wind guiding port 42 of the outer muffler protector 40 (downstream in the direction in which the exhaust gas flows). In addition, a scoop-shaped inner wind guiding passage 53 extending to the inner wind guiding port 52 is formed therein.

The outer muffler protector 40 is assembled onto the upper surface of the inner muffler protector 41 in advance. Thereafter, the resultant inner muffler protector is attached to the upper surface of the muffler main body 10.

In addition to the above-mentioned attachment bosses 44, 45 (which are also used to fasten the front and rear muffler protectors 40F, 40R), different attachment bosses 56, 57, 58 for pre-assembling are provided on the back surface of the outer muffler protector 40. On the other hand, attachment holes 60, 61, 62, 63, 64 for pre-assembling are provided on the upper surface of the inner muffler protector 41 corresponding to the attachment bosses 44, 45, 56, 57, 58 for pre-assembling, respectively. The dual-structure muffler protector MP is pre-assembled by integrally joining the inner muffler protector 41 and the outer muffler protector 40 by fastening these attachment bosses 44, 45, 56, 57, 58 to the attachment holes 60, 61, 62, 63, 64 by use of the fastening screws s, respectively.

The dual-structure muffler protector MP, which includes the inner muffler protector 41 and the outer muffler protector 40, is adjacently attached to the upper surface of the muffler main body 10 by use of the protector stay PS1 and the different protector stay PS2.

The attachment stays 38, 39 are respectively provided at the rear end of the protector stay PS1 and the front end of the different protector stay PS2. In addition, shock-absorbing grommets 72, 73 are respectively provided at the rear portion of the protector stay PS1 and the trunk section 11 of the muffler main body 10. On the other hand, attachment holes 75, 76, 77 and support holes 78, 79 are opened in the pre-assembled muffler protector MP corresponding to the attachment stays 38, 39 and the shock-absorbing grommets 72, 73. The pre-assembled muffler protector MP is adjacently attached to the upper surface of the muffler main body 10 by fastening fastener bolts b to the attachment stays 38, 39 through the attachment holes 75, 76, 77 (see FIG. 8), and making the shock-absorbing grommets 72, 73 engage with the support holes 78, 79 (see FIG. 8).

Next, descriptions will be provided for how this embodiment works.

The exhaust gas produced by the operation of the engine E is guided to the muffler M via the exhaust pipe 8. Inside the muffler M, the exhaust gas at high temperature flows into the inside of the catalyst CA, where the harmful substances such as HC, CO, and NOx are removed. Thereafter, the exhaust gas, heated to high temperature, passes through the catalyst chamber 15 and flows to the expansion chamber 17. Inside the expansion chamber 17, the exhaust gas flows through the first expansion chamber $\mathbf{17}_1$, the communicating pipes 20, the second expansion chamber $\mathbf{17}_2$, the different communicating pipe 21, and the third expansion chamber $\mathbf{17}_3$ in this sequence. During this flow, the exhaust gas noise is reduced. The resultant exhaust gas flows from the third expansion chamber $\mathbf{17}_3$ to the outlet pipe 22 and is discharged to the outside via the tail pipe 14.

In the meantime, diffusion in a direction of radiation of the hot air emitted from the muffler M, which is heated to high temperature due to the exhaust heat of the exhaust gas and the heat of reaction from the catalyst CA, is curbed by the protector stay PS1 and the different protector stay PS2 each shaped like a plate, not only while the motorcycle is running by the operation of the engine E but also after the operation of the engine E is stopped. In addition, a hot wind or hot air flowing from the upstream to downstream sides of the muffler can be discharged to the rear after passing between the upper surface of the muffler M and the protector stay PS1 via the front and rear openings 35, 36 which are formed between the muffler M and the front and rear portions of the protector stay PS1. A rise in the temperature of the muffler protector MP covering the outer side of the muffler M can be curbed near the seat S for a rider. Thus, the diffusion of the hot air to the outside of the vehicle body can be curbed near the seat S. Particularly because the muffler protector MP has the dual structure, a rise in the temperature of the outer muffler protector 40 can be curbed as much as possible. For these reasons, it is possible to place the muffler protector PM adjacent to the muffler M, and to curb the outward bulge thereof which comes from an increase in the size of the muffler protector MP, as well as to enhance the external appearance. Particularly when this muffler M is placed closer to the seat S (as the up muffler), the external appearance can be enhanced more.

Furthermore, because the wind guiding ports 42, 52 for guiding the running wind are opened on the upstream side of the muffler protector MP covering the protector stay PS1, the running wind which flows along the lateral side of the vehicle body can be efficiently guided to the inside of the muffler protector MP while the motorcycle is running. Accordingly, the protector stays PS and the muffler protector MP can be effectively air-cooled by this running wind.

Moreover, because the protector stay SP1 and the different protector stay PS2 are attached to the muffler M with a gap between the protector stay PS1 and the different protector stay PS2 in the front-rear direction (longitudinal direction) of the muffler M, and because the wind guiding ports 42, 52 opened in the muffler protector MP are situated in the space between the protector stays PS1, PS2, the protector stay PS1 and the different protector stay PS2 enable the large-sized muffler protector MP widely covering the muffler M to be stably supported by the muffler M. Moreover, the running wind from the wind guiding ports 42, 52 can be efficiently guided to the interstice between the muffler M and the muffler protector MP without being disturbed by the protector stays PS1, PS2, and the heated parts, including the inside of the protector stay PS1 and the interstice between the protector stay PS1 and the muffler protector MP, can be efficiently cooled.

Because the rear outer muffler protector 40R, which is the rear portion of the outer muffler protector 40 is formed of the material which is higher in heat resistance than that of the front outer muffler protector 40F which is the front portion of the outer muffler protector 40, the use of the expensive material with the higher heat resistance can be limited to the necessary area, and the inexpensive material which is low in heat resistance but good in external appearance can be used in the wider area. Thereby, it is possible to reduce the costs and to enhance the external appearance while securing the heat resistance.

Because the outer and inner wind guiding ports 42, 52 are respectively formed in the outer and inner muffler protectors 40, 41 in the dual structure in a way that shifts the outer and inner wind guiding ports 42, 52 from each other in the front-rear direction, the running wind can be efficiently guided to the outer surface of the muffler M via the wind guiding ports 42, 52 although the muffler protector MP is formed having the dual structure. In addition, because the inner wind guiding port 52 of the inner muffler protector 41 is not exposed to the outside, it is possible to enhance the external appearance of the dual-structure muffler protector MP.

Because the muffler protector MP is attached to the muffler M after the outwardly-situated outer muffler protector 40 and the inwardly-situated inner muffler protector 41 are pre-assembled, it is possible to enhance ease of assembly and maintenance of the muffler protector MP despite its dual structure.

Because the area including the rearmost second expansion chamber $\mathbf{17}_2$, which becomes highest in temperature due to the movement of the hot air (as a result of the muffler M being inclined upward from front to back) after the engine is stopped, is covered with the protector stay PS1, it is possible to enhance the effect of heat insulation by the protector stay PS1, to effectively curb a rise in the temperature of the muffler protector MP, and accordingly to contribute to constructing the muffler system with a protector in a much smaller size and enhancing the external appearance.

Although the foregoing descriptions have been provided for the embodiment of the present invention, the invention is not limited to the embodiment. Various examples can be carried out within the scope of the present invention.

For instance, although the foregoing descriptions have been provided for the case where the muffler system with a protector of the present invention is carried out in the saddle riding-type motorcycle, it goes without saying that the muffler system with a protector of the present invention can also be carried out in small-sized vehicles such as other types of motorcycles and three-wheel motorcycles.

EXPLANATION OF THE REFERENCE NUMERALS

| | |
|---|---|
| 1 | VEHICLE BODY FRAME |
| 8 | EXHAUST PIPE |
| $17_1$ | EXPANSION CHAMBER (FIRST EXPANSION CHAMBER) |
| $17_2$ | EXPANSION CHAMBER (SECOND EXPANSION CHAMBER, REARMOST EXPANSION CHAMBER) |
| $17_3$ | EXPANSION CHAMBER (THIRD EXPANSION CHAMBER) |
| 35 | FRONT OPENING |
| 36 | REAR OPENING |
| 40 | OUTER MUFFLER PROTECTOR |
| 40F | FRONT OUTER MUFFLER PROTECTOR (FRONT PART) |
| 40R | REAR OUTER MUFFLER PROTECTOR (REAR PART) |
| 41 | INNER MUFFLER PROTECTOR |
| 42 | OUTER WIND GUIDING PORT |
| 52 | INNER WIND GUIDING PORT |
| CA | CATALYST |
| E | ENGINE |
| M | MUFFLER |
| S | SEAT |
| MP | MUFFLER PROTECTOR |
| PS1 | PROTECTOR STAY |
| PS2 | DIFFERENT PROTECTOR STAY |
| Wr | REAR WHEEL |

The invention claimed is:

1. A muffler system for a vehicle, said muffler system comprising:

an exhaust pipe configured to be connected to an exhaust port of an engine at an upstream side thereof;

a muffler containing a catalyst therein, said muffler being configured to be connected to a downstream side of the exhaust pipe, and including a plate-shaped first protector stay covering an upper surface of a high-temperature portion of the muffler, wherein the first protector stay is disposed so as to create a front opening and a rear opening between an upper surface of the muffler and front and rear portions of the first protector stay; and a muffler protector attached to the first protector stay, the muffler protector being configured to cover an upper surface of the muffler, wherein the muffler protector comprises an outer muffler protector and an inner muffler protector, a rear portion of the outer muffler protector comprises a material which has a higher heat resistance than a material of a front portion of the outer muffler protector, and the outer muffler protector and the inner muffler protector are provided on an outer peripheral surface of a trunk section of a main body of the muffler.

2. The muffler system according to claim 1, wherein the muffler protector extends to cover the first protector stay and the muffler, and wherein wind guiding ports are disposed in an intermediate area of a front portion of the muffler protector, the wind guiding ports being configured to guide air therethrough.

3. The muffler system according to claim 2, further comprising a second protector stay attached to the muffler, said first and second protector stays being configured such that a gap in a front-rear direction is disposed between the first and second protector stays, and wherein the wind guiding ports are disposed between the first protector stay and the second protector stay.

4. The muffler system according to claim 1, wherein wind guiding ports are disposed in the outer and inner muffler protectors.

5. The muffler system according to claim 1, wherein the muffler comprises a plurality of separators which forms a plurality of expansion chambers, wherein the separators partition an inside of the muffler, and wherein the first protector stay covers an upper surface of a rear area including an expansion chamber which is rearmost among the plurality of expansion chambers.

6. A muffler system for a vehicle, said muffler system comprising:

exhaust pipe means for directing exhaust from an engine;

muffler means for muffling exhaust noise, said muffler means including catalyst means therein for catalyzing exhaust gases, said muffler means being connected to a downstream side of the exhaust pipe means, and including first protector stay means for covering an upper surface of a high-temperature portion of the muffler means, wherein the first protector stay means is disposed to create a front opening and a rear opening between an upper surface of the muffler means and front and rear portions of the first protector stay means; and muffler protector means attached to the first protector stay means, the muffler protector means for covering an upper surface of the muffler means, wherein the muffler protector means comprises an outer muffler protector means and an inner muffler protector means, a rear portion of the outer muffler protector means comprises a material which has a higher heat resistance than a material of a front portion of the outer muffler protector means, and the outer muffler protector means and the inner muffler protector means are provided on an outer peripheral surface of a trunk section of a main body of the muffler means.

7. The muffler system according to claim 6, wherein the muffler protector means extends to cover the first protector stay means and an outer portion of the muffler, and wherein wind guiding ports are disposed in an intermediate area of a front portion of the muffler protector means, the wind guiding ports for guiding air therethrough.

8. The muffler system according to claim 7, further comprising a second protector stay means attached to the muffler means, said first and second protector stay means providing a gap in a front-rear direction disposed therebetween, and wherein the wind guiding ports are disposed between the first protector stay means and the second protector stay means.

9. The muffler system according to claim 6, wherein wind guiding ports are disposed in the outer and inner muffler protector means.

10. The muffler system according to claim 6, wherein the muffler means comprises a plurality of separator means for forming a plurality of expansion chambers therein, wherein the separator means partition an inside of the muffler means, and wherein the first protector stay means covers an upper surface of a rear area including an expansion chamber which is rearmost among the plurality of expansion chambers.

* * * * *